United States Patent [19]

Lee et al.

[11] Patent Number: 4,684,403

[45] Date of Patent: Aug. 4, 1987

[54] DEPHOSPHORIZATION PROCESS FOR MANGANESE-CONTAINING ALLOYS

[75] Inventors: Young E. Lee, Youngstown; James H. Downing, Clarence; Robert H. Kaiser, Youngstown, all of N.Y.

[73] Assignee: Elkem Metals Company, Pittsburgh, Pa.

[21] Appl. No.: 876,245

[22] Filed: Jun. 19, 1986

[51] Int. Cl.[4] ..... C22B 47/00; C21C 7/02

[52] U.S. Cl. ..... 75/80; 75/53; 75/58

[58] Field of Search ..... 75/53, 58, 80

[56] References Cited

U.S. PATENT DOCUMENTS

| | | | |
|---|---|---|---|
| 4,364,771 | 12/1982 | Cordier | 75/58 |
| 4,391,633 | 7/1983 | Yamauchi | 75/58 |
| 4,450,004 | 5/1984 | Matsuo | 75/58 |

*Primary Examiner*—Peter D. Rosenberg

*Attorney, Agent, or Firm*—Lucas & Just

[57] ABSTRACT

A method for dephosphorizing a manganese containing melt is disclosed. The method encompasses the addition of a magnesium compound to a manganese containing melt to form magnesium phosphides which are removed from the melt. The method is carried out under pressure and the addition of a flux in the melt is employed to facilitate the removal of the phosphides from the melt.

26 Claims, No Drawings

DEPHOSPHORIZATION PROCESS FOR MANGANESE-CONTAINING ALLOYS

This invention relates to the removal of impurities from metal and metal alloys and more particularly to a process for removing phosphorus from ferromanganese.

In the production of steel, manganese and ferromanganese are important additives which improve the rolling and forging qualities, strength, toughness, stiffness, wear resistance, hardness and hardenability of steel. Generally, the addition of manganese to steel is accomplished by the addition of a ferromanganese alloy to the melt. Ferromanganese alloys are generally classified by carbon content into three categories. One category, low carbon ferromanganese, has less than about 0.75% carbon content by weight of alloy and about 80 to 95% manganese by weight of alloy. Medium carbon ferromanganese is characterized as having between about 0.75 to 1.5% carbon content by weight and between about 76 to 90% manganese by weight. The final major category of ferromanganese is high carbon or standard ferromanganese. This generally contains between about 2 to 7% carbon by weight and between about 76 to 82% manganese by weight.

Sulfur and phosphorus occur naturally in both manganese and iron ores and are considered to be two of the most harmful impurities in the production of steel. Phosphorus makes steel brittle at high temperature while sulfur makes steel brittle at ordinary temperature. Phosphorus also makes steel susceptible to hot- and stress-corrosion cracking. Therefore, low phosphorus containing ferromanganese alloys are important to the production of high quality steel.

Generally, the American Iron and Steel Institute (AISI) standards call for not more than about 0.040% phosphorus by weight and not more than about 0.050% sulfur by weight for steel. Both manganese ores and iron ores contain up to as much as about 0.50% by weight phosphorus based on the weight of the ore.

Generally, ferromanganese alloys are produced by carbothermic reduction of manganese ores and most of the phosphorus in the ores passes into the smelted ferromanganese alloys.

The phosphorus in a ferromanganese melt is not easily removed and dephosphorization processes cannot be carried out under oxidizing conditions.

Calcium and its alloys have been proposed as dephosphorizing agents. However, calcium has a great affinity for carbon and will combine more readily with the carbon than with phosphorus, thus the efficiency of its use for removing phosphorus is low for the ferromanganese alloys containing substantial amounts of carbon. The use of calcium carbide is taught by Japanese patent No. 57-161039. However, calcium carbide is less effective when applied to carbon saturated alloys. The addition of calcium carbide to non-carbon saturated alloys will result in a higher carbon level.

There is a need for an effective and efficient method for removing phosphorus from manganese alloys.

An effective and efficient method for removing phosphorus from manganese and its alloys has now been discovered. This method encompasses the addition of a magnesium compound to the manganese containing melt to remove phosphorus. The amount of magnesium compound added to the melt can vary and is approximately proportional to the amount of phosphorus removed from the melt.

One major advantage of this process is that the magnesium in the magnesium compound will combine with impurities in the melt such as phosphorus, sulfur, arsenic, antimony, tin, and nitrogen, but will not readily affect other elements which are generally wanted in the finished product such as carbon, silicon, manganese, and iron. Thus, the magnesium strips the melt of impurities while leaving other desirable elements in the melt.

The exact chemistry of the process of the present invention is not known, however, it is believed that the magnesium reacts with the phosphorus to form magnesium phosphides. The magnesium phosphides are generally less dense than the alloys in the melt and float to the surface of the melt.

The process of the present invention has been found to work especially well for dephosphorizing melts containing manganese, especially ferromanganese melts. The process of this invention can also work in silicomanganese melts. It is preferred that the process of the present invention be employed on low, medium and high carbon ferromanganese melts.

In order to practice the process of the present invention, a magnesium compound is added to a manganese containing melt.

The term magnesium compound as used in the specification and claims herein means magnesium or a magnesium alloy which provides the melt with magnesium to combine with impurities in the melt. Pure metallic magnesium and certain magnesium alloys work very well. A suitable magnesium alloy is magnesium silicide ($Mg_2Si$). Magnesium or magnesium silicide is preferred.

The amount of magnesium compound needed to dephosphorize the melt will vary depending on the amount of phosphorus desired to be removed from the melt and the amount of magnesium contained within the compound. It has been found that about 10–30 pounds of magnesium are needed for removing about one pound of phosphorus from a high carbon ferromanganese melt while about 10–100 pounds of magnesium are needed for removing one pound of phosphorus from a medium carbon ferromanganese melt, wherein the melt initially contained about 0.04 to 0.5% by weight phosphorus. Preferably about 10–100 pounds of magnesium is added to a melt for removing about one pound of phosphorus wherein the melt initially contained about 0.04 to 0.5% by weight phosphorus. The amount of magnesium is based on the weight of magnesium (Mg) in the magnesium compound. In other words, the ratio of magnesium added:phosphorus removed is about 10:1 to about 30:1 in a high carbon ferromanganese melt which initially contained about 0.04 to 0.5% by weight phosphorus and the ratio of magnesium added:phosphorus removed is about 10:1 to about 100:1 in a medium carbon ferromanganese melt which initially contained about 0.04 to 0.5% by weight phosphorus. Larger amounts of magnesium can be used without any commercial advantage.

As is known, the boiling point of magnesium is below the melting point of manganese. Thus, magnesium vaporizes readily when added to a manganese melt. This aspect of the magnesium effects the residence time of the magnesium in the melt and must be taken into consideration in determining how to add the magnesium compound into the manganese containing melt. The method for adding the magnesium compound to the melt should be such that it maximizes the residence time of the magnesium in the manganese containing melt.

Any number of conventional means can be employed to introduce the magnesium compound into the melt. Such methods include plunging, steel jacketed wire feeding, injection, and bubbling gaseous magnesium through a manganese alloy melt. Plunging is the preferred method. Pressurizing the melt retards the rate of vaporization of the magnesium along with any of the above four methods. This pressure can be provided by ferrostatic or external pressure.

It has been found that by maintaining the melt under pressure improved the dephosphorization of the melt and it is preferred that the dephosphorization occur at a pressure greater than atmospheric, preferably above about 1 atmosphere gauge. More preferably, the treatment is carried out at between 1–4 atmospheres gauge and even more preferred is that the treatment be carried out between about 2–4 atmospheres gauge. A pressure of about 2 atmospheres gauge has been found to be convenient for manufacturing purposes and to provide good results. Higher pressures can be used without any appreciable commercial advantage. The pressure can be provided by ferrostatic pressure of the melt or by external pressure.

Although it is possible to remove the phosphides from the top of the melt in a conventional manner, it is preferable to use a flux to facilitate the removal of the phosphides. When a flux is used the magnesium phosphides combine with the flux and the phosphide containing flux is removed from the surface of the melt in a conventional manner.

Any conventional flux can be used in practicing this invention so long as the magnesium phosphide resides therein. Suitable fluxes include magnesium fluoride, calcium fluoride, lime, manganese slag, magnesium ores such as dolomite or magnesite, or any combination of individual fluxes. A novel aspect of the present invention is that manganese slag, which was heretofore considered a waste product from various refining processes, can be used successfully as a flux in the present invention. The use of manganese slag as a suitable flux was both surprising and unexpected by the inventors. Great economic benefit can be had with the use of manganese slag because it is a by-product of many metallurgical refining processes and thus is inexpensive and easily obtained.

Further details and advantages of the present invention will readily be understood by reference to the following examples.

EXAMPLE 1

This example illustrates treating a high carbon ferromanganese alloy with a magnesium compound in accordance with the present invention. A high carbon ferromanganese alloy and fluxes were placed in a graphite crucible which in turn was placed in a 50 kW induction furnace contained in a steel pressure vessel. Immediately above the crucible a steel can containing magnesium silicide was attached to a plunging rod in preparation for addition to the melt. The vessel was then closed, evacuated, and pressurized with argon gas. The crucible was then heated slowly to melt the charge. The melt temperature was monitored by a thermocouple and raised to about 1300° C. After the temperature had stabilized at 1300° C., the suspended can containing the magnesium silicide was plunged into the melt. About 8–10 minutes later, the furnace power was turned off and the crucible was allowed to cool under pressure.

Table I below shows the weight of the high carbon ferromanganese alloy and magnesium fluoride added to the melt and the amount of magnesium silicide added to the melt. Table I also shows the pressure at which the reaction was run as well as the percentages of phosphorus, carbon and silicon contained within the alloy before and after the treatment.

The magnesium silicide was prepared by cutting a commercially available magnesium ingot into small pieces and combining it with a commercially available silicon metal and co-melting the two. The melt was cooled and a magnesium silicide was obtained therefrom. The magnesium silicide contained about 60.8% by weight magnesium and about 36.26% by weight silicon.

TABLE I

| | Run No.: | | | | |
|---|---|---|---|---|---|
| | I-1 | I-2 | I-3 | I-4 | I-5 |
| High Carbon Ferromanganese alloy (g) | 3178 | 3178 | 3178 | 3178 | 3178 |
| Magnesium Silicide (g) | 100 | 192 | 200 | 200 | 165 |
| Magnesium Fluoride (g) | 70 | 140 | 140 | — | 140 |
| Pressure (atm. gauge) | 4.08 | 4.08 | 4.08 | 4.08 | 4.08 |
| Before Treatment Weight % in the Ferromanganese | | | | | |
| Phosphorus | 0.33 | 0.33 | 0.34 | 0.34 | 0.335 |
| Carbon | 6.7 | 6.7 | 6.7 | 6.7 | 6.7 |
| Silicon | 0.68 | 0.68 | 0.68 | 0.68 | 0.68 |
| After Treatment Weight % in the Ferromanganese | | | | | |
| Phosphorus | 0.21 | 0.12 | 0.09 | 0.11 | 0.079 |
| Carbon | 6.34 | 6.00 | 6.15 | 6.29 | 6.09 |
| Silicon | 1.35 | 1.85 | 2.32 | 2.16 | 1.83 |
| Degree of Dephosphorization (%)* | 36.4 | 63.6 | 73.5 | 67.7 | 76.4 |

$$\text{*Degree of Dephosphorization} = \frac{\text{weight \% } P_{(initial)} - \text{weight \% } P_{(final)}}{\text{weight \% } P_{(initial)}} \times 100$$

As is readily apparent from Table I, the degree of dephosphorization increases with the amount of magnesium silicide used to treat the melt. It is also readily apparent from Table I above that the magnesium silicide did not significantly affect the carbon content of the alloy. It will be noted that the silicon content of the alloy after treatment is higher than the silicon content of the alloy before treatment. This is due to the fact that silicon is introduced into the alloy through use of the magnesium silicide dephosphorizing agent.

EXAMPLE 2

This example illustrates the use of the present invention using magnesium metal as a magnesium compound and varying the pressure at which the treatment is conducted. Otherwise, the procedure in Example 1 was followed.

TABLE II

| Run No.: | II-1 | II-2 | II-3 | II-4 | II-5 | II-6 | II-7 |
|---|---|---|---|---|---|---|---|
| High Carbon Ferromanganese alloy (g) | 3178 | 3178 | 3178 | 3178 | 3178 | 3178 | 3178 |
| Magnesium Metal (g) | 100 | 100 | 100 | 100 | 100 | 100 | 100 |

TABLE II-continued

| Run No.: | II-1 | II-2 | II-3 | II-4 | II-5 | II-6 | II-7 |
|---|---|---|---|---|---|---|---|
| Magnesium Fluoride (g) | 140 | 140 | 160 | 160 | 160 | 160 | 160 |
| Pressure (atm. gauge) | 4.08 | 5.10 | 4.76 | 3.74 | 2.72 | 2.04 | 0.00 |
| Before Treatment Weight % in the Ferromanganese | | | | | | | |
| Phosphorus | 0.335 | 0.335 | 0.34 | 0.34 | 0.34 | 0.34 | 0.34 |
| Carbon | 6.7 | 6.7 | 6.7 | 6.7 | 6.7 | 6.7 | 6.7 |
| Silicon | 0.68 | 0.68 | 0.68 | 0.68 | 0.68 | 0.68 | 0.68 |
| After Treatment Weight % on the Ferromanganese | | | | | | | |
| Phosphorus | 0.12 | 0.14 | 0.135 | 0.13 | 0.135 | 0.13 | 0.29 |
| Carbon | 6.58 | 6.58 | 6.60 | 6.47 | 6.59 | 6.74 | 6.52 |
| Silicon | 0.43 | 0.43 | 0.69 | 0.64 | 0.82 | 0.57 | 0.75 |
| Degree of Dephosphorization (%) | 64.2 | 58.2 | 60.3 | 61.8 | 60.3 | 61.8 | 14.7 |

It is readily apparent that the effect of the dephosphorizing agent is affected by the pressure. The magnesium was the commercially available magnesium used in Example 1 to prepare the magnesium silicide.

EXAMPLE 3

This example illustrates the use of magnesium metal as a magnesium compound without the use of a flux in the melt. Otherwise, the procedure in Example 1 was followed.

TABLE III

| Run No.: | III-1 | III-2 | III-3 | III-4 | III-5 |
|---|---|---|---|---|---|
| High Carbon Ferromanganese alloy (g) | 3178 | 3178 | 3178 | 3178 | 3178 |
| Magnesium Metal (g) | 100 | 100 | 100 | 100 | 100 |
| Pressure (atm. gauge) | 4.08 | 4.76 | 3.74 | 2.72 | 2.04 |
| Before Treatment Weight % in the Ferromanganese | | | | | |
| Phosphorus | 0.335 | 0.34 | 0.34 | 0.34 | 0.34 |
| Carbon | 6.7 | 6.7 | 6.7 | 6.7 | 6.7 |
| Silicon | 0.68 | 0.68 | 0.68 | 0.68 | 0.68 |
| After Treatment Weight % in the Ferromanganese | | | | | |
| Phosphorus | 0.105 | 0.135 | 0.13 | 0.13 | 0.14 |
| Carbon | 6.79 | 6.52 | 6.51 | 6.59 | 6.69 |
| Silicon | 0.43 | 0.81 | 0.78 | 0.76 | 0.64 |
| Degree of Dephosphorization (%) | 68.7 | 60.3 | 61.8 | 61.8 | 58.8 |

It is readily apparent that the effect of the magnesium compound without the flux is comparable to the effect with a flux. The magnesium was the commercially available magnesium used in Example 1 to prepare the magnesium silicide.

EXAMPLE 4

This example illustrates the use of manganese slag as a flux as compared to the use of magnesium fluoride as a flux. Otherwise, the procedure in Example 1 was followed. The results of the tests are shown in Table IV below.

TABLE IV

| Run No.: | IV-1 | IV-2 |
|---|---|---|
| High Carbon Ferromanganese Alloy (g) | 3178 | 3178 |

TABLE IV-continued

| Run No.: | IV-1 | IV-2 |
|---|---|---|
| Magnesium Metal (g) | 100 | 100 |
| Magnesium Fluoride (g) | — | 160 |
| Manganese Slag (g) | 300 | — |
| Pressure (atm. gauge) | 3.74 | 3.74 |
| Before Treatment Weight % in the Ferromanganese | | |
| Phosphorus | 0.32 | 0.34 |
| Carbon | 6.7 | 6.7 |
| Silicon | 0.68 | 0.68 |
| After Treatment Weight % in the Ferromanganese | | |
| Phosphorus | 0.12 | 0.13 |
| Carbon | 6.67 | 6.47 |
| Silicon | 0.60 | 0.64 |
| Degree of Dephosphorization (%) | 62.5 | 61.8 |

It is readily apparent from the above Table that the use of either a manganese slag or a magnesium fluoride as a flux does not affect the magnesium compound. The magnesium was the commercially available magnesium used in Example 1 to prepare the magnesium silicide.

EXAMPLE 5

This Example illustrates treating a medium carbon ferromanganese alloy melt with magnesium metal in accordance with the present invention. Otherwise, the procedure in Example 1 was followed for treating the melt except a magnorite crucible was used.

TABLE V

| Run No.: | V-1 | V-2 | V-3 | V-4 |
|---|---|---|---|---|
| Medium Carbon Ferromanganese alloy (g) | 3178 | 3178 | 3178 | 3178 |
| Magnesium Metal (g) | 150 | 150 | 150 | 150 |
| Magnesium Fluoride (g) | 160 | 160 | 160 | 160 |
| Pressure (atm. gauge) | 4.8 | 3.1 | 2.0 | 1.0 |
| Before Treatment Weight % in the Ferromanganese | | | | |
| Phosphorus | 0.32 | 0.32 | 0.32 | 0.32 |
| Carbon | 2.1 | 2.1 | 2.1 | 2.1 |
| Silicon | 0.35 | 0.35 | 0.35 | 0.35 |
| After Treatment Weight % in the Ferromanganese | | | | |
| Phosphorus | 0.2 | 0.255 | 0.30 | 0.325 |
| Carbon | 2.15 | 2.05 | 2.08 | 2.10 |
| Silicon | 0.145 | 0.165 | 0.20 | 0.155 |

As is readily apparent from Table V, phosphorus in medium carbon ferromanganese alloy is reduced by treating with magnesium metal. It was noted in this experiment that other tramp elements such as sulfur, arsenic, and nitrogen were removed from medium carbon ferromanganese alloy by treating with magnesium metal. The magnesium was the commercially available magnesium used in Example 1 to prepare the magnesium silicide.

EXAMPLE 6

This Example illustrates the removal of tramp elements such as sulfur, arsenic, and nitrogen from a high carbon ferromanganese alloy by treating with magnesium metal or magnesium compound. Otherwise, the procedure of Example 1 was followed for treating the melt except for run numbers VI-2 and VI-5 where no flux was added.

TABLE VI

| Run No.: | VI-1 | VI-2 | VI-3 | VI-4 | VI-5 |
|---|---|---|---|---|---|
| High Carbon Ferromanganese alloy (g) | 3178 | 3178 | 3178 | 3178 | 3178 |
| Magnesium Metal (g) | — | — | — | 100 | 100 |
| Magnesium Silicide (g) | 200 | 200 | 168 | — | — |
| Magnesium Fluoride (g) | 140 | — | 140 | 140 | — |
| Pressure (atm. gauge) | 4.08 | 4.08 | 4.08 | 4.08 | 4.08 |
| Before Treatment Weight % in the Ferromanganese | | | | | |
| Sulfur | 0.0075 | 0.0075 | 0.0045 | 0.0045 | 0.0045 |
| Arsenic | 0.070 | 0.070 | 0.0565 | 0.0565 | 0.0565 |
| Nitrogen | 0.0375 | 0.0375 | 0.059 | 0.059 | 0.059 |
| After Treatment Weight % in the Ferromanganese | | | | | |
| Sulfur | 0.004 | 0.003 | 0.008 | 0.003 | 0.003 |
| Arsenic | 0.012 | 0.022 | 0.0225 | 0.0255 | 0.0175 |
| Nitrogen | 0.010 | 0.011 | 0.0125 | 0.0105 | 0.0095 |

It is readily apparent that the levels of sulfur. aresenic, and nitrogen in high carbon ferromanganese are reduced by treating with magnesium metal or magnesium silicide. The magnesium silicide was the same as used in Example 1 and the magnesium was the commercially available magnesium used in Example 1 to prepare the magnesium silicide.

Although the process of this invention has been described mainly in terms of dephosphorizing manganese containing melts and especially ferromanganese melts, it is equally applicable to employ the teachings of the present invention to stainless steel alloys to remove phosphorus therefrom or to remove phosphorus from a melt employed in the production of ferromanganese alloy.

It will be understood that the claims are intended to cover all changes and modifications of the preferred embodiment of the present invention herein chosen for the purpose of illustration which do not constitute a departure from the spirit and scope of the invention.

What is claimed is:

1. A method for dephosphorizing a ferromanganese melt comprising:

(a) forming a melt ferromanganese; and (b) adding to said melt a magnesium compound to dephosphorize said melt.

2. The method of claim 1 wherein said magnesium compound is magnesium silicide or magnesium metal.

3. The method of claim 1 further comprising the step of maintaining the melt at a pressure greater than atmospheric before and after the addition of said magnesium compound.

4. The method of claim 1 wherein the melt contains a flux.

5. The method of claim 1 wherein said magnesium compound is added to said melt such that the ratio of magnesium added:phosphorus removed is about 10:1 to about 30:1 wherein said melt initially contained about 0.04 to about 0.5% by weight phosphorus.

6. The method of claim 4 wherein the flux is manganese slag.

7. The method of claim 4 further comprising the step of removing the flux from the melt after the addition of the magnesium compound.

8. A method for dephosphorizing a ferromanganese melt comprising:

(a) forming a melt ferromanganese;

(b) adding to said melt a flux; and (c) adding to said melt a maqnesium compound to dephosphorize said melt.

9. The method of claim 8 further comprising the step of maintaining said melt under a pressure greater than atmospheric before and after the addition of said magnesium compound.

10. The method of claim 9 wherein the magnesium compound is magnesium metal or magnesium silicide and said pressure is between about 1 to 4 atmospheres gauge.

11. A method for dephosphorizing a melt containing manganese comprising the steps of:

(a) forming a melt containing above about 75% manganese;

(b) adding a magnesium compound to said melt; and (c) maintaining said melt before and after the addition of said magnesium compound above atmospheric pressure thereby dephosphorizing said melt.

12. The method of claim 11 further comprising the addition of a flux to said melt and a step of removing said flux from said melt after the addition of said magnesium compounds.

13. A method for dephosphorizing a ferromanganese melt comprising the steps of:

(a) forming a ferromanganese melt containing above about 75% manganese;

(b) adding a flux to said melt;

(c) placing said melt under pressure greater than atmospheric;

(d) adding to said melt a magnesium compound;

(e) maintaining said melt under pressure; and (f) removing said flux from said melt.

14. The method of claim 13 wherein said magnesium compound is magnesium silicide or magnesium metal and said flux is magnesium fluoride or manganese slag.

15. The method of claim 14 wherein said pressure is about 2 atmospheres gauge.

16. A manganese alloy dephosphorized by the method of claim 1.

17. A manganese alloy contain above about 75% manganese dephosphorized by the method of claim 11.

18. A manganese ferromanganese alloy dephosphorized by the method of claim 13.

19. A method for removing impurities selected from the group consisting of phosphorus, sulfur, arsenic, antimony, tin and nitrogen from a ferromanganese melt comprising the steps of:

(a) forming a ferromanganese melt;

(b) adding a magnesium compound to said melt to remove said impurities.

20. The method of claim 19 further comprising the step of maintaining said melt under a pressure greater than atmospheric before and after the addition of said magnesium compound.

21. The method of claim 20 wherein said magnesium compound is magnesium metal or magnesium silicide.

22. The method of claim 21 further comprising the step of adding a flux to said melt to facilitate the removal of said impurities.

23. A method for dephosphorizing a silicomanganesee melt comprising:

(a) forming a silicomanganesee melt; and (b) adding to said melt magnesium or a magnesium compound to dephosphorize said melt.

24. The method of claim 23 wherein said magnesium or magnesium compound is magnesium silicide.

25. The method of claim 24 further comprising the step of manitaining said melt at a pressure greater than atmospheric before and after the addition of said magnesium compound.

26. The method for dephosphorizing a melt containing manganese comprising the steps of:

(a) forming a melt containing at least about 65% manganese;

(b) adding a magnesium compound to said melt, and (c) maintaining said melt before and after the addition of said magnesium compound above atmospheric pressure thereby dephosphorizing said melt.

* * * * *

UNITED STATES PATENT AND TRADEMARK OFFICE

CERTIFICATE OF CORRECTION

PATENT NO. : 4,684,403

DATED : August 4, 1987

INVENTOR(S) : Young E. Lee et al.

It is certified that error appears in the above-identified patent and that said Letters Patent is hereby corrected as shown below:

Column 7, line 55, change "melt ferromanganese" to --ferromanganese melt--.

Column 8, line 10, change "melt ferromanganese" to --ferromanganese melt--.

Column 8, line 50, change "manganese" to --ferromanganese--.

Column 8, line 54, delete "manganese".

Signed and Sealed this

Fifteenth Day of March, 1988

*Attest:*

*Attesting Officer*

DONALD J. QUIGG

*Commissioner of Patents and Trademarks*